United States Patent [19]

Hoge

[11] Patent Number: 4,872,658

[45] Date of Patent: Oct. 10, 1989

[54] FOLDER FOR BUSINESS FORMS PRESS

[75] Inventor: Ross A. Hoge, Westmount, Canada

[73] Assignee: M-A-N Ashton Inc., Montreal, Canada

[21] Appl. No.: 197,203

[22] Filed: May 23, 1988

[51] Int. Cl.[4] ..... B41L 1/32

[52] U.S. Cl. ..... 270/39; 493/414

[58] Field of Search ..... 270/30, 31, 39, 40; 493/410, 411, 412, 413, 414

[56] References Cited

U.S. PATENT DOCUMENTS

| | | | |
|---|---|---|---|
| 3,717,335 | 2/1973 | Faltin | 493/414 |
| 4,181,052 | 1/1980 | Kopp | 270/39 |
| 4,427,404 | 1/1984 | Yamada | 493/414 |
| 4,508,527 | 4/1985 | Uno | 270/40 |

FOREIGN PATENT DOCUMENTS

| | | | |
|---|---|---|---|
| 1170362 | 5/1964 | Fed. Rep. of Germany | 493/412 |
| 2312442 | 12/1976 | France | 493/414 |
| 46-872 | 1/1971 | Japan | 493/414 |
| 8803509 | 5/1988 | PCT Int'l Appl. | 270/31 |

*Primary Examiner*—Robert E. Garrett
*Assistant Examiner*—Therese M. Newholm
*Attorney, Agent, or Firm*—Samuel Meerkreebs

[57] ABSTRACT

A pendulum type folder chute detachably mounted to spindles journalled in the side frame walls and having duplicate crank arrangements on either side thereof, including a crank arm, a link arm, and a drive wheel on either side frame such that the mass and driving force of the crank arrangement is balanced. The drive wheel includes a stroke adjustment feature which includes a circular recess defined in the outer surface of the drive wheel, the center of which is offset from the axis of rotation of the drive wheel, and a circular disc is provided in the circular recess rotatable therewithin and having its geometric center coinciding with the geometric center of the recess. A plurality of holes are in a circular locus in the recess coinciding with the locus of a plurality of holes provided on the disc near the periphery thereof. Bolt means pass through the holes in the disc to engage the holes in the recess to thereby lock the disc in a selected position. The second disc mounts a spindle which is offset from the geometric center thereof such that when the disc is rotatably adjusted and locked within the recess, the eccentricity of the spindle relative to the center of the first disc can be varied, and a linking arm is connected to the spindle such that the stroke of the chute can be adjusted by adjusting the relative position of the second disc to the wheel in the recess thereof.

7 Claims, 4 Drawing Sheets

10
12
72
20a
54a
59a
18
74a
22a
14
42
34
28
C
36
40
38
24a
42

FOLDER FOR BUSINESS FORMS PRESS

BACKGROUND OF THE INVENTION

1. Field of the Invention

The present invention relates to business forms presses, and more particularly, to a mechanism for folding a continuous web of paper into stacks after the press operations have been completed.

2. Description of the Prior Art

It is well known in the field of business forms presses to provide folder-stackers at the output end of a business forms press. Such presses are characterized by the provision of a plurality of mechanical units effecting various operations on a continuous web of paper. Such units usually include printing towers, a perforator, a numbering unit, a lateral slitter, and a folder-stacker unit. These operations are conducted at very high speeds and must be well synchronized.

The folder design is extremely critical to the speed, since a typical design employs a pendulum lever construction. The folder is the weak link on the press as far as speed is concerned. Typically a folder for a business forms press comprises a pendulum chute extending transversely across the path of the web which is driven by a crank arm connected to a link arm which in turn is connected to a drive wheel for actuating the reciprocating pendulum motion of the chute. Of course, the higher the speed of the press, the more difficult it is to select materials and design for the delivery chute of the folder. Presently, for instance, a carbon fiber composite is used in the construction of the chute. However, present folder designs impede the progrress of such presses toward higher speeds.

SUMMARY OF THE INVENTION

It is an aim of the present invention to provide an improved folder mechanism for a business forms press wherein the pitch (stroke) of the chute of the folder can be infinitely adjustable and positively locked.

It is a further aim of the present invention to provide a folder mechanism capable of high speeds such as in the range of 1300 r.p.m., i.e., 8½" fold @ 1800 f.p.m.

A construction in accordance with the present invention comprises a web folding structure including a frame, the frame including a pair of parallel side walls, one on either side of the web to be folded. A chute extends transversely between the side walls across the web, the chute including spindle means on either end thereof journalled in bearings in the respective side walls to allow the chute to pivot about a pivot axis extending through the spindles. The chute further includes a pair of closely spaced wall surfaces defining an elongated slot adapted to pass the web therethrough. The slot defined by the wall surfaces includes a plane passing through the pivot axis. The chute extends below the pivot axis to provide a pendulum motion. At least a crank arm is connected to one of the spindles, and a link arm is connected at one end to the crank arm at a point spaced from the pivot axis. The other end of the link arm is connected to a drive wheel eccentrically thereof, providing a pendulum motion to the crank arm and thus the chute. The invention is characterized in that the drive wheel includes a first disc mounted to a shaft, drive means for rotation of the first disc about an axis passing through the geometric center of the first disc. The first disc defines a circular recess in the outer surface thereof, wherein the geometric center of the circular recess is offset from the center of the first disc but the circular recess contains the geometric center of the first disc. A second disc is rotatable in the circular recess. The second disc has a geometric center coincident with the geometric center of the circular recess. The linking arm is eccentrically connected to the second disc such that the axis of the linking arm connection to the second disc is parallel to the axis of rotation of the first disc. Means are provided for detachably locking the second disc to the first disc within the circular recess such that the degree of eccentricity of the linking arm connection to the second disc can be adjusted relative to the rotation axis of the first disc to thereby adjust the stroke of the pendulum motion of the chute.

In a more specific embodiment of the present invention, there is a duplicate structure mounted outside both side walls including a drive wheel which includes a first and second disc with the first disc on the other side wall mounted to the same shaft as the first disc on the one side wall of the frame, and a crank arm is mounted to the other spindle of the chute with an identical link arm connected to the crank arm and the second disc on the other side wall such that the mass and driving force of the moving parts mounting the pendulum chute is equal on both sides of the frame, thereby reducing distortions in the chute when the chute is reciprocating at high speeds.

In a further construction of the present invention, the chute is detachably mounted to the spindles in a manner whereby the chute can be replaced for a chute having different characteristics. In a specific construction, each spindle is independently journalled in bearings in the respective side walls of the frame, with each spindle having a female slot for receiving a male fin means provided at each end of the chute, and fastening means are provided for detachably fastening the fins in a respective slot.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
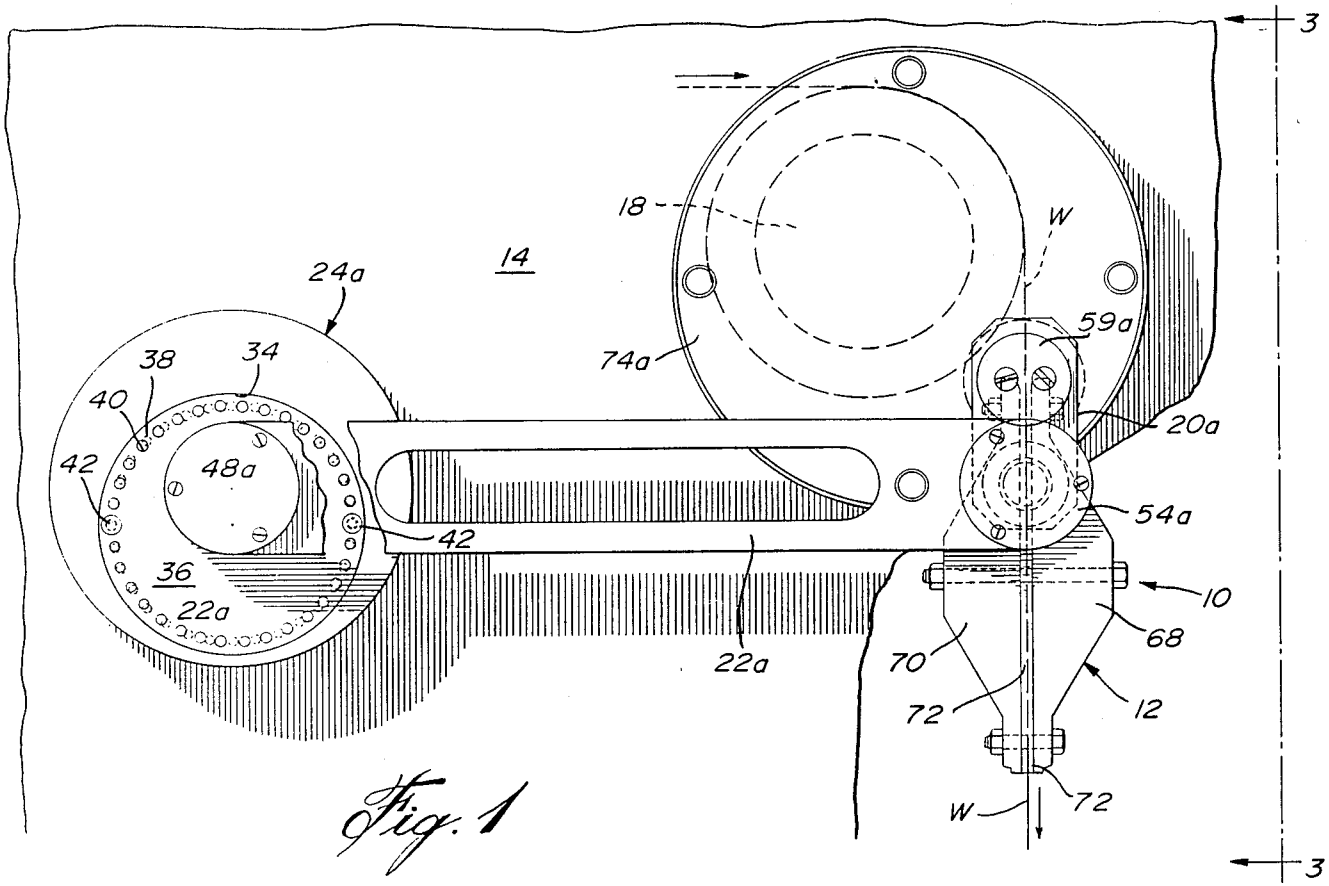
FIG. 1 is a fragmentary side elevation of a folder in accordance with the present invention.

Referring now to the drawings, there is shown generally a folder 10 which is mounted between side frame members 14 and 16 of a business forms press. The web of paper W passes over a pulling cylinder 18 which is driven, and passes into the chute 12 to be folded on a stack in a well-known manner.

As will be described, for every element in the crank mechanism on the side from 14, there is an equivalent element on the side frame 16 and auxiliary wall 26, and for that reason, identical reference numerals have been used and differentiated by the subscripts "a" and "b". Therefore, elements which have the subscript "a" are generally associated with the side frame 14, which numerals with the subscript "b" are gereally associated with the side frame 16 and auxiliary wall 26.

Figure 4:
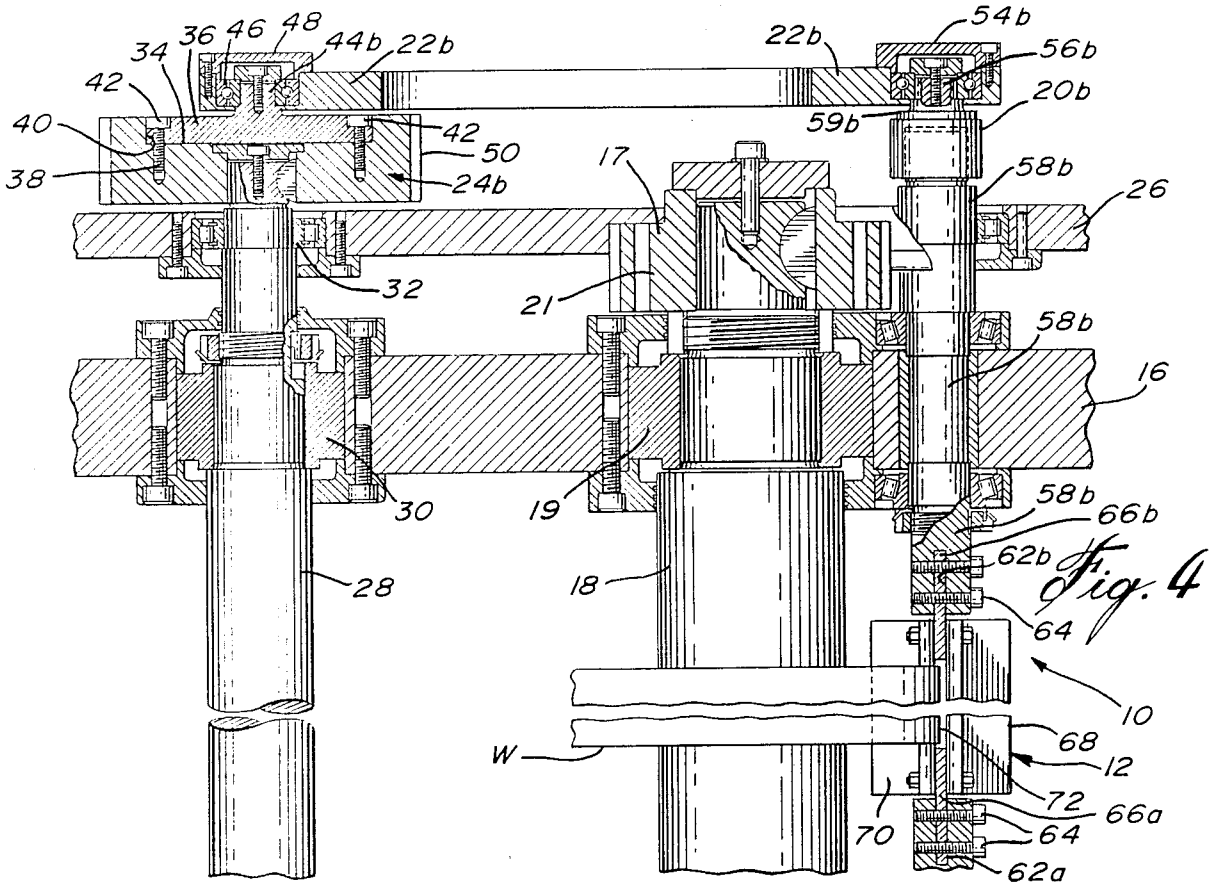
FIG. 4 is a horizontal cross-section taken somewhat along line 4—4 of FIG. 3.

The folder 10 has a crank arm 20 and a link arm 22*a* mounted to a drive wheel 24. Referring to FIG. 4, there is shown an auxiliary wall 26 spaced from the side frame 16 and the drive gears are mounted on wall 26. The crank mechanism for swinging or reciprocating the chute 12 is balanced in the sense that the same mass is duplicated on either side of the frame represented by the frame walls 14 and 16.

Since the gear drive is mounted to the auxiliary wall 26, the drive wheel 24*b* has gear teeth 50 engaging drive gears (not shown). The drive wheel 24*a* is blank, and fixedly mounted to the shaft 28 which, as will be described, is rotated by the drive wheel 24*b*.

The pulling cylinder 18 is mounted in the side frames 14 and 16 by means of bearings 19. A gear 21 is keyed to the end of the shaft mounting the cylinder 18 for driving the cylinder in synchronous movement with the remainder of the business forms press.

Figure 2:
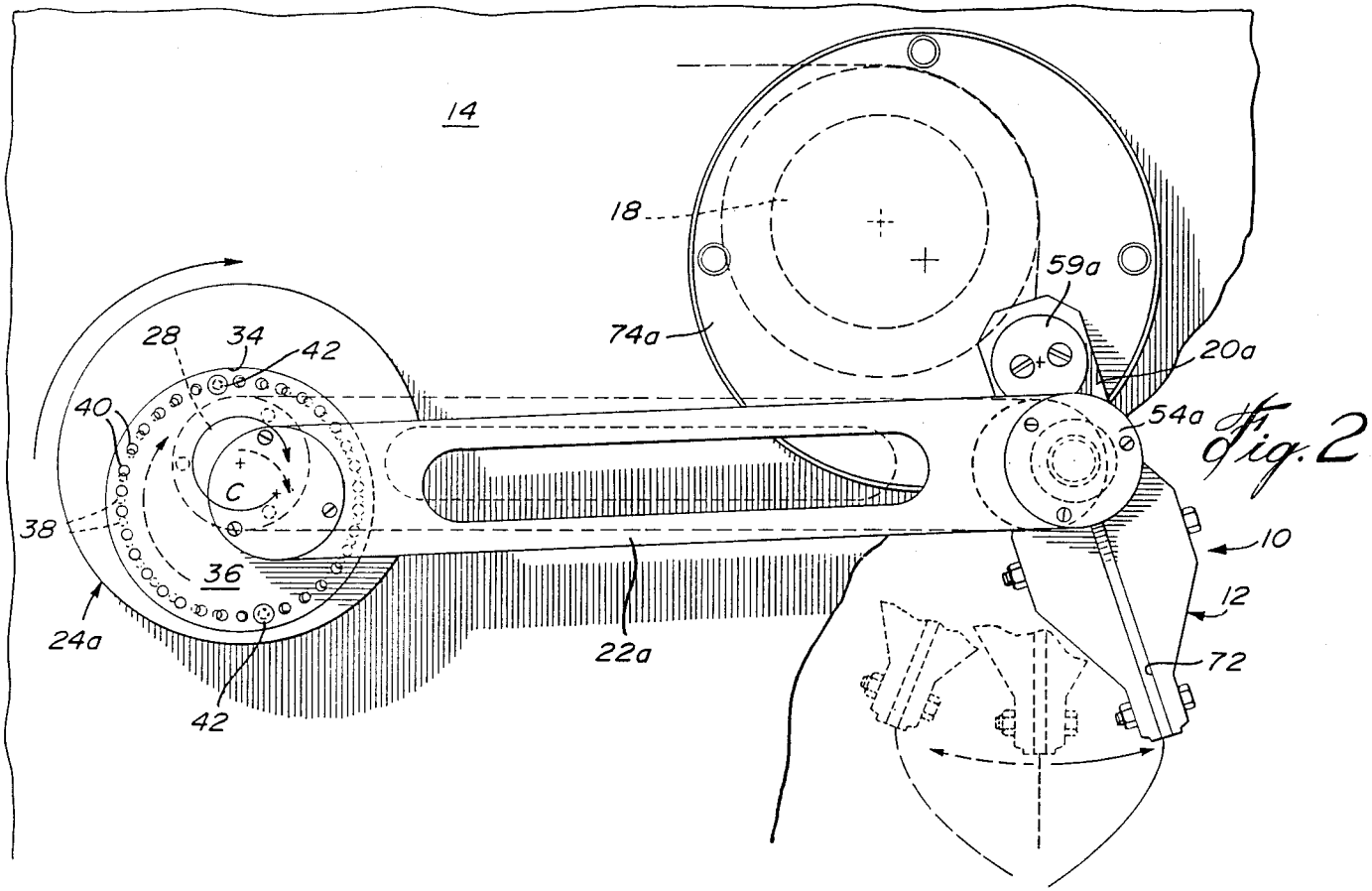
FIG. 2 is a fragmentary side elevation, similar to FIG. 1, showing the folder in a different operative position.

Referring to the crank mechanism shown in FIGS. 1 and 2, the drive wheel 24*a* is shown as being mounted to the end of the shaft 28, and the geometric center C of the wheel 24*a* coincides with the axis rotation of the shaft 28. The drive wheel 24*a* is provided with a circular recess 34, machined in the wheel 24*a*. The center of circular recess 34 is offset from the center C, and thus the circular recess 34 is eccentric relative to the wheel 24*a* which also has a circular periphery.

As best seen in FIG. 4, the identical drive wheel 24*b* shown in cross-section, illustrates the recess 34 with disc 36 set therein. The disc 36 is circular and has the same diameter as the circular recess 34 and is adapted to rotate therewithin. The geometric center of the disc 36 is coincident with the geometric center of the recess 34.

The bottom wall of the recess 34 is provided with a series of threaded holes 38 in a circular locus. In a given example, there are 32 holes spaced equidistantly in a circular locus near the periphery of the recess. The disc 36 has a series of 34 holes 40 having the same locus as the locus of the threaded holes 38. Thus, only two diametrically opposed holes 40 of the disc 36 are aligned with holes 38 in the recess 34. Fastening means, such as bolts 42, pass through the openings 40 into the threaded openings 38 in the first wheel 24. The disc 36 mounts a spindle 44 eccentrically, that is, offset to the geometric center of the disc 36. The spindle 44*b* in FIG. 4 is directly connected to link arm 22*b* by means of bearings 46. A bearing cap 48 covers the end of the spindle 44*b*.

As shown in FIG. 4, the link arm 22*b* is connected to the spindle 44*b* by means of bearing 46. The other end of the link arm 22*b* is connected by way of a bearing to the spindle 56*b* at the end of crank arm 20*b* which is fixedly connected to the protruding end of the spindle 58*b*. Spindle 58*b* is journalled in a bearing in the side frame wall 16 and 26.

Thus, when it is necessary to vary the stroke of the chute, the eccentricity of the spindle 44*b* is adjusted relative to the axis C of wheel 24 by rotatably adjusting the disc 36 relative to the recess 34 and thus to the wheel 24*b*. In other words, by rotating the wheel 36 in drive wheel 24*a* clockwise, as shown in FIG. 2, the spindle hidden under the cap 48*a* will move away from the center C, increasing the distance of the spindle 44*a* from the axis C, thereby increasing the crank or eccentricity of the link arm 22*a* which will provide a stroke of greater magnitude to the chute 12. As is evident, the clockwise rotation of the drive wheels 24*a* and 24*b* by means of the shaft 28 will cause a reciprocating rocking movement to the link arms 22*a* and 22*b* which in turn will cause the crank arms 20*a* and 20*b* to swing, thereby moving the spindles 58*a* and 58*b* which in turn will provide the swinging movement to the chute 12. As previously described, by adjusting the disc 36 relative to the wheel 24, the stroke will be increased or decreased. In fact, theoretically, the stroke could be at 0 if the disc 36 is adjusted such that the axis of the spindle 44*a* and 44*b* is coincident with the axis C of the drive wheels 24*a* and 24*b*.

Figure 3:
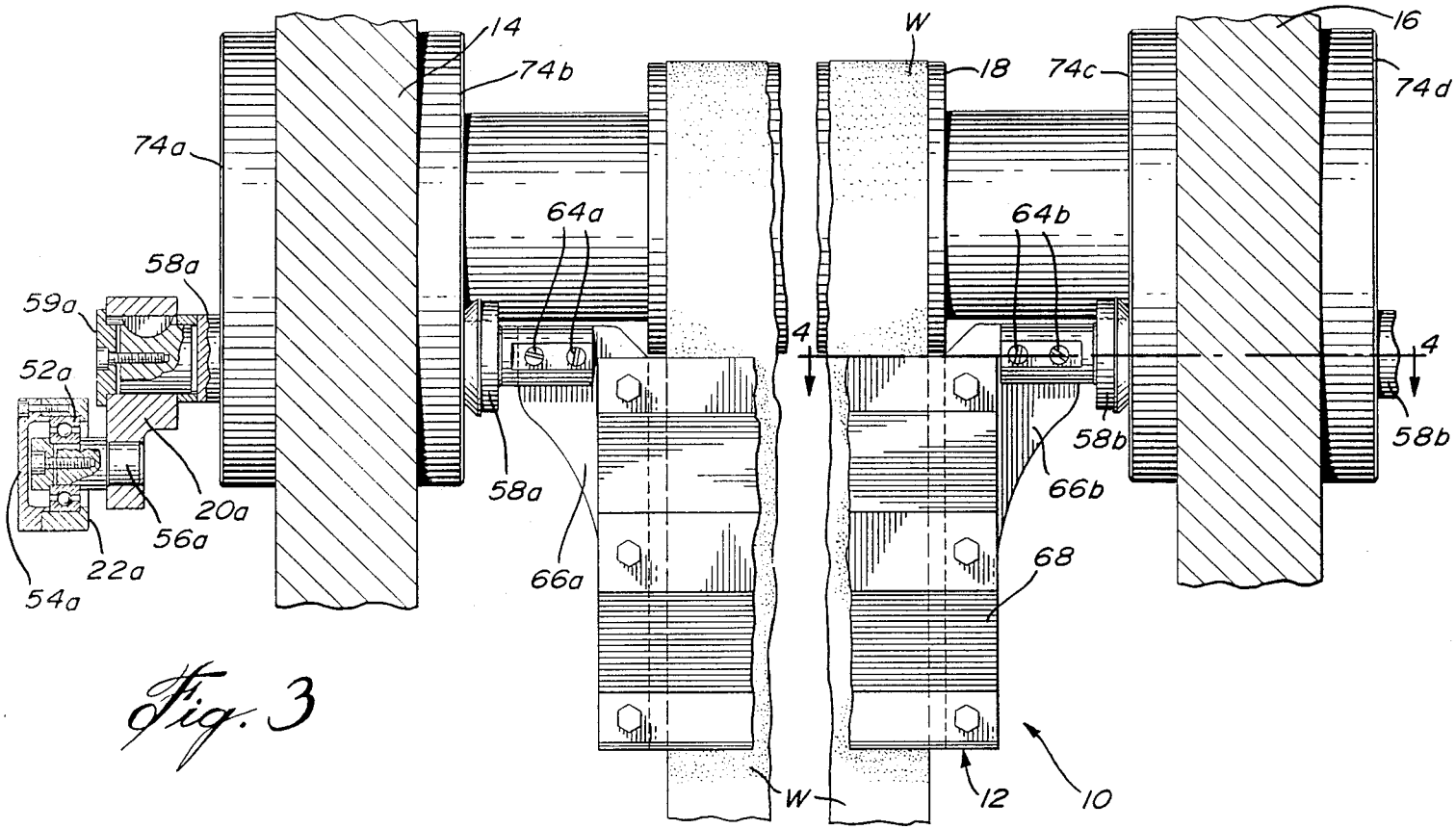
FIG. 3 is a fragmentary front elevation, partly in cross-section, taken along line 3—3 of FIG. 1.

The chute is easily removable from between the spindles 58*a* and 58*b*. Reference herein is made to FIGS. 3 and 4 where the chute is shown having panels 68 and 70 defining an elongated slot 72 through which the paper web W passes. To each end of the chute, there is sandwiched between the panels 68 and 70 a fin 66*a* and 66*b* respectively which projects longitudinally thereof and which is adapted to be received within slots 62*a* and 62*b* respectively in the spindles 58*a* and 58*b*. Bolts 64 lock the fins 66 in the slots 62.

I claim:

1. A web folding structure comprising a frame, the frame including a pair of parallel side walls, one on either side of the web to be folded, a chute extending transversely between the side walls across the web, the chute including spindle means on either end thereof journalled in bearings in the respective side walls allowing the chute to pivot about a pivot axis extending through the spindles, the chute further including a pair of closely spaced wall surfaces defining an elongated slot adapted to pass the web therethrough, the slot defined by the wall surfaces including a plane passing through the pivot axis with the chute extending below the pivot axis to provide a pendulum motion; at least a crank arm connected to one of the spindles and a link arm connected at one end to the crank arm at a point spaced from the pivot axis, the other end of the link arm being connected to a drive wheel eccentrically thereof for providing a pendulum motion to the crank and thus the chute, characterized in that the drive wheel includes a first disc mounted to a shaft, drive means for rotating the first disc about an axis of rotation passing through the geometric center of the first disc, the first disc defining a circular recess in the outer surface thereof with the geometric center of the circular recess being offset from the axis of rotation of the first disc but the circular recess containing the geometric center of the first disc, a second disc rotatable in the circular recess, the second disc having a geometric center coincident with the geometric center of the circular recess, the linking arm being eccentrically connected to the second disc such that the axis of the linking arm connection to the second disc is parallel to the axis of rotation of the first disc, and means are provided for detachably locking the second disc to the first disc within the circular recess such that the degree of eccentricity of the linking arm connection to the second disc can be adjusted relative to the rotation of the axis of the first disc to thereby adjust the stroke of the pendulum motion of the chute.

2. A folder as defined in claim 1, wherein the frame is part of a business forms press, and the folder is mounted at the delivery end of the business forms press, and the drive wheel is driven by the drive mechanism of the business forms press.

3. A folder as defined in claim 1, wherein the means for detachably locking the second disc to the first disc within the circular recess includes a plurality of threaded holes in said recess forming a circular locus and a plurality of holes in the second disc having a locus forming a circle coincident with the circular locus in the threaded holes in the recess, and bolt means provided for inserting through the holes in the second disc to engage holes in the first disc in the recess thereof.

4. A folder as defined in claim 3, wherein there are a greater number of holes in the second disc than in the first disc such that only two holes are ever aligned from the second disc to the holes in the recess.

5. A folder as defined in claim 4, wherein a spindle is mounted on the second disc offset from the geometric center of the second disc providing the connection with the linking arm.

6. A folder as defined in claim 1, wherein for each element provided on the one side frame wall, there is an equivalent identical element provided on the other side frame wall such that duplicate drive wheel means, disc means, link arm means, crank arm means, and spindle means are provided on either side of the frame, whereby the mass and driving force of the crank mechanism is balanced on either side of the frame to thereby reduce distortion in the chute during high speed reciprocating movement thereof.

7. A folder as defined in claim 6, wherein the drive wheel means provided adjacent one of the side frames is mounted on a shaft extending through the two side frames and journalled therein, the drive wheel including gear teeth and being engaged with gear means for driving the drive wheel and thus the shaft, the drive wheel on the other side of the frame being blank but fixedly mounted to the other end of the shaft for rotation therewith.

* * * * *